US009646629B2

(12) United States Patent
Gao

(10) Patent No.: US 9,646,629 B2
(45) Date of Patent: May 9, 2017

(54) SIMPLIFIED BEAMFORMER AND NOISE CANCELLER FOR SPEECH ENHANCEMENT

(71) Applicant: Yang Gao, Mission Viejo, CA (US)

(72) Inventor: Yang Gao, Mission Viejo, CA (US)

( * ) Notice: Subject to any disclaimer, the term of this patent is extended or adjusted under 35 U.S.C. 154(b) by 0 days.

(21) Appl. No.: 14/702,685

(22) Filed: May 2, 2015

(65) Prior Publication Data

US 2015/0317999 A1 Nov. 5, 2015

Related U.S. Application Data

(60) Provisional application No. 61/988,296, filed on May 4, 2014.

(51) Int. Cl.

| | |
|---|---|
| ***G10L 21/0208*** | (2013.01) |
| ***G10L 21/0216*** | (2013.01) |
| ***H04R 1/00*** | (2006.01) |
| ***H04R 3/00*** | (2006.01) |
| *H04R 25/00* | (2006.01) |

(52) U.S. Cl.

CPC ..... *G10L 21/0216* (2013.01); *G10L 21/0208* (2013.01); *H04R 1/00* (2013.01); *H04R 3/005* (2013.01); *G10L 2021/02165* (2013.01); *G10L 2021/02166* (2013.01); *H04R 25/407* (2013.01); *H04R 2225/43* (2013.01)

(58) Field of Classification Search

CPC ..... G10L 21/0208; H04R 1/00

USPC ..... 704/226, 231, 237, 238

See application file for complete search history.

(56) References Cited

U.S. PATENT DOCUMENTS

| | | | | |
|---|---|---|---|---|
| 2008/0101622 | A1* | 5/2008 | Sugiyama | H04M 9/082 381/66 |
| 2011/0194719 | A1* | 8/2011 | Frater | H04R 27/00 381/332 |
| 2013/0322655 | A1* | 12/2013 | Schuldt | G10L 21/02 381/119 |
| 2014/0169568 | A1* | 6/2014 | Li | H04R 5/04 381/17 |

* cited by examiner

*Primary Examiner* — Marcellus Augustin

(57) ABSTRACT

In accordance with an embodiment of the present invention, a noise/interference reduction method for speech enhancement processing includes selecting one of the microphones as a main microphone wherein the signal from the main microphone is used as a target signal, the selection of the main microphone is adaptive for mono output case, and the selection of the main microphone is fixed for stereo output case. The noise/interference component signal is estimated by subtracting voice component signal from a first microphone input signal wherein the voice component signal is evaluated as a first replica signal produced by passing a second microphone input signal through a first adaptive filter. A noise/interference reduced signal is output by subtracting a second replica signal from the target signal, wherein the second replica signal is produced by passing the estimated noise/interference component signal through a second adaptive filter.

12 Claims, 8 Drawing Sheets

(Pre-Art)

SIMPLIFIED BEAMFORMER AND NOISE CANCELLER FOR SPEECH ENHANCEMENT

This application claims the benefit of U.S. Provisional Application No. 61/988,296 filed on May 4, 2014, entitled "Simplified Beamformer and Noise Canceller for Speech Enhancement," U.S. Provisional Application No. 61/988,298 filed on May 4, 2014, entitled "Stepsize Determination of Adaptive Filter For Cancelling Voice Portion by Combing Open-Loop and Closed-Loop Approaches," U.S. Provisional Application No. 61/988,297 filed on May 4, 2014, entitled "Single MIC Detection in Beam-former and Noise Canceller for Speech Enhancement," U.S. Provisional Application No. 61/988,299 filed on May 4, 2014, entitled "Noise Energy Controlling In Noise Reduction System With Two Microphones," which application is hereby incorporated herein by reference.

TECHNICAL FIELD

The present invention is generally in the field of Noise Reduction/Speech Enhancement. In particular, the present invention is used to improve Microphone Array Beamformer for background noise cancellation or interference signal cancellation.

BACKGROUND

Beamforming is a technique which extracts the desired signal contaminated by interference based on directivity, i.e., spatial signal selectivity. This extraction is performed by processing the signals obtained by multiple sensors such as microphones located at different positions in the space. The principle of beamforming has been known for a long time. Because of the vast amount of necessary signal processing, most research and development effort has been focused on geological investigations and sonar, which can afford a high cost. With the advent of LSI technology, the required amount of signal processing has become relatively small. As a result, a variety of research projects where acoustic beamforming is applied to consumer-oriented applications such as cellular phone speech enhancement, have been carried out. Microphone array could contain multiple microphones; for the simplicity, two microphones array system is widely used.

Applications of beamforming include microphone arrays for speech enhancement. The goal of speech enhancement is to remove undesirable signals such as noise and reverberation. Amount research areas in the field of speech enhancement are teleconferencing, hands-free telephones, hearing aids, speech recognition, intelligibility improvement, and acoustic measurement.

Beamforming can be considered as multi-dimensional signal processing in space and time. Ideal conditions assumed in most theoretical discussions are not always maintained. The target DOA (direction of arrival), which is assumed to be stable, does change with the movement of the speaker. The sensor gains, which are assumed uniform, exhibit significant distribution. As a result, the performance obtained by beamforming may not be as good as expected. Steering vector errors are inevitable because the propagation model does not always reflect the non-stationary physical environment. The steering vector is sensitive to errors in the microphone positions, those in the microphone characteristics, and those in the assumed target DOA (which is also known as the look direction). For teleconferencing and hands-free communication, the error in the assumed target DOA is the dominant factor. Therefore, robustness against steering-vector errors caused by these array imperfections are become more and more important.

A beamformer which adaptively forms its directivity pattern is called an adaptive beamformer. It simultaneously performs beam steering and null steering. In most traditional acoustic beamformers, however, only null steering is performed with an assumption that the target DOA is known a priori. Due to adaptive processing, deep nulls can be developed. Adaptive beamformers naturally exhibit higher interference suppression capability than its fixed counterpart which may be called fixed beamformer.

The traditional adaptive beamformer/noise cancellation suffers from target speech signal cancellation due to steering vector errors, which is caused by an undesirable phase difference between two microphones input signals for the target. This is specially true when the target source or the microphone array is moving in space. Even if the phase between two microphones input signals is aligned, the output target signal from a fixed beamformer could still possibly have lower SNR (target signal to noise ratio) than the best one of the microphone array component signals; this means that one of the microphones could possibly receive higher SNR than the output target signal from a fixed beamformer. A phase error leads to target signal leakage, which results in target signal cancellation at the output. Adaptive filter technology is a widely used to adaptively and precisely align the target signals from different microphones.

SUMMARY

In accordance with an embodiment of the present invention, a noise/interference reduction method for speech enhancement processing includes selecting one of the microphones as a main microphone wherein the signal from the main microphone is used as a target signal, the selection of the main microphone is adaptive for mono output case, and the selection of the main microphone is fixed for stereo output case. The noise/interference component signal is estimated by subtracting voice component signal from a first microphone input signal wherein the voice component signal is evaluated as a first replica signal produced by passing a second microphone input signal through a first adaptive filter. A noise/interference reduced signal is output by subtracting a second replica signal from the target signal, wherein the second replica signal is produced by passing the estimated noise/interference component signal through a second adaptive filter.

In an alternative embodiment, a speech processing apparatus comprises a processor, and a computer readable storage medium storing programming for execution by the processor. The programming include instructions to select one of the microphones as a main microphone wherein the signal from the main microphone is used as a target signal, the selection of the main microphone is adaptive for mono output case, and the selection of the main microphone is fixed for stereo output case. The noise/interference component signal is estimated by subtracting voice component signal from a first microphone input signal wherein the voice component signal is evaluated as a first replica signal produced by passing a second microphone input signal through a first adaptive filter. A noise/interference reduced signal is output by subtracting a second replica signal from the target signal, wherein the second replica signal is produced by passing the estimated noise/interference component signal through a second adaptive filter.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

Figure 1:
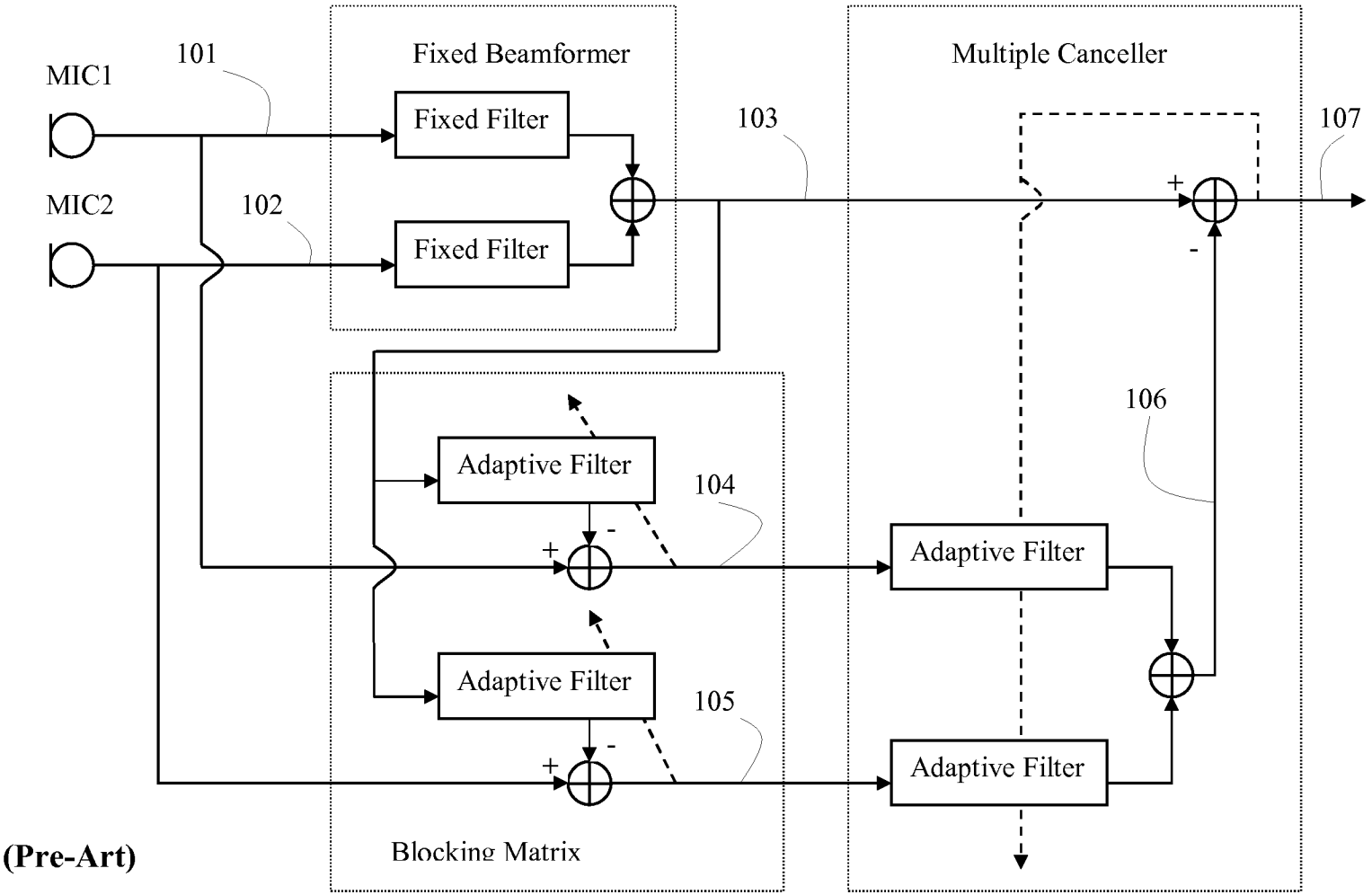
FIG. 1 illustrates a structure of a widely known adaptive beamformer among various adaptive beamformers. For the simplicity, only two microphones are shown.

FIG. 1 depicts a structure of a widely known adaptive beamformer among various adaptive beamformers. Microphone array could contain multiple microphones; for the simplicity, FIG. 1 only shows two microphones. FIG. 1 comprises a fixed beamformer (FBF), a multiple input canceller (MC), and blocking matrix (BM). The FBF is designed to form a beam in the look direction so that the target signal is passed and all other signals are attenuated. On the contrary, the BM forms a null in the look direction so that the target signal is suppressed and all other signals are passed through. The inputs 101 and 102 of FBF are signals coming from MICs. 103 is the output target signal of FBF. 101, 102 and 103 are also used as inputs of BM. The MC is composed of multiple adaptive filters each of which is driven by a BM output. The BM outputs 104 and 105 suppose to contain all the signal components except that in the look direction or that of the target signal. Based on these signals, the adaptive filters in MC generate replicas 106 of components correlated with the interferences. All the replicas are subtracted from a delayed output signal of the fixed beamformer which contains an enhanced target signal component. In the subtracter output 107, the target signal is enhanced and undesirable signals such as ambient noise and interferences are suppressed.

Figure 2:
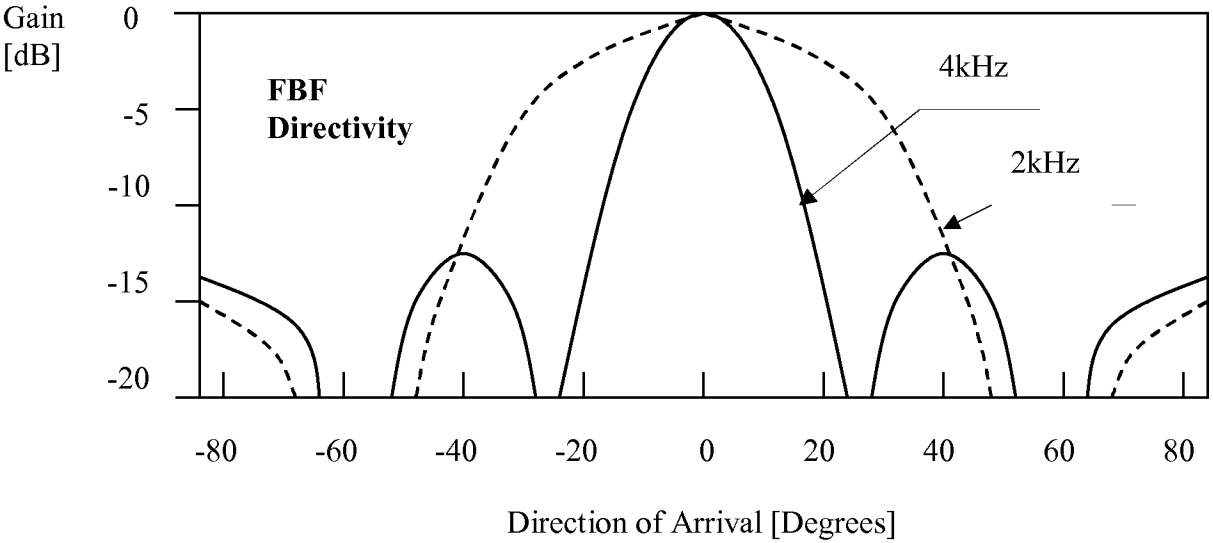
FIG. 2 illustrates an example of directivity of a fixed beamformer which outputs a target signal.

FIG. 2. shows an example of directivity of the FBF wherein the highest gain is shown in the looking direction.

Figure 3:
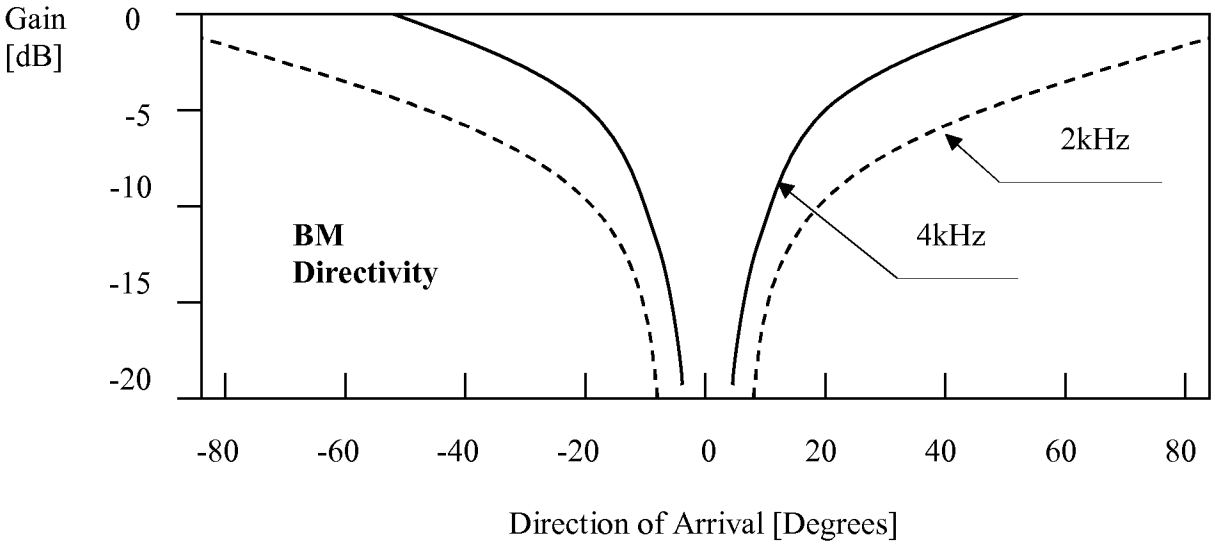
FIG. 3 illustrates an example of directivity of a block matrix which outputs reference noise/interference signals.

FIG. 3. shows an example of directivity of the BM wherein the lowest gain is shown in the looking direction.

In real applications, the looking direction of the microphones array does not always or exactly faces the coming direction of the target signal source. For example, in teleconferencing and hands-free communication, there are several speakers located at different positions while the microphones array is fixed and not adaptively moved to face the speaker. Another special example is stereo application in which the two signals from two microphones can not be mixed to form one output signal otherwise the stereo characteristic is lost. The above traditional adaptive beamformer/noise cancellation suffers from target speech signal cancellation due to steering vector errors, which is caused by an undesirable phase difference between two microphones input signals for the target. This is specially true when the target source or the microphone array is randomly moving in space. Even if the phase between two microphones input signals is aligned, the output target signal from the FBF could still possibly have lower SNR (target signal to noise ratio) than the best one of the microphone array component signals; this means that one of the microphones could possibly receive higher SNR than the mixed output target signal from the FBF. A phase error leads to target signal leakage into the BM output signal. As a result, blocking of the target becomes incomplete in the BM output signal, which results in target signal cancellation at the MC output. Steering vector errors are inevitable because the propagation model does not always reflect the non-stationary physical environment. The steering vector is sensitive to errors in the microphone positions, those in the microphone characteristics, and those in the assumed target DOA (which is also known as the look direction). For teleconferencing and hands-free communication, the error in the assumed target DOA is the dominant factor.

Figure 4:
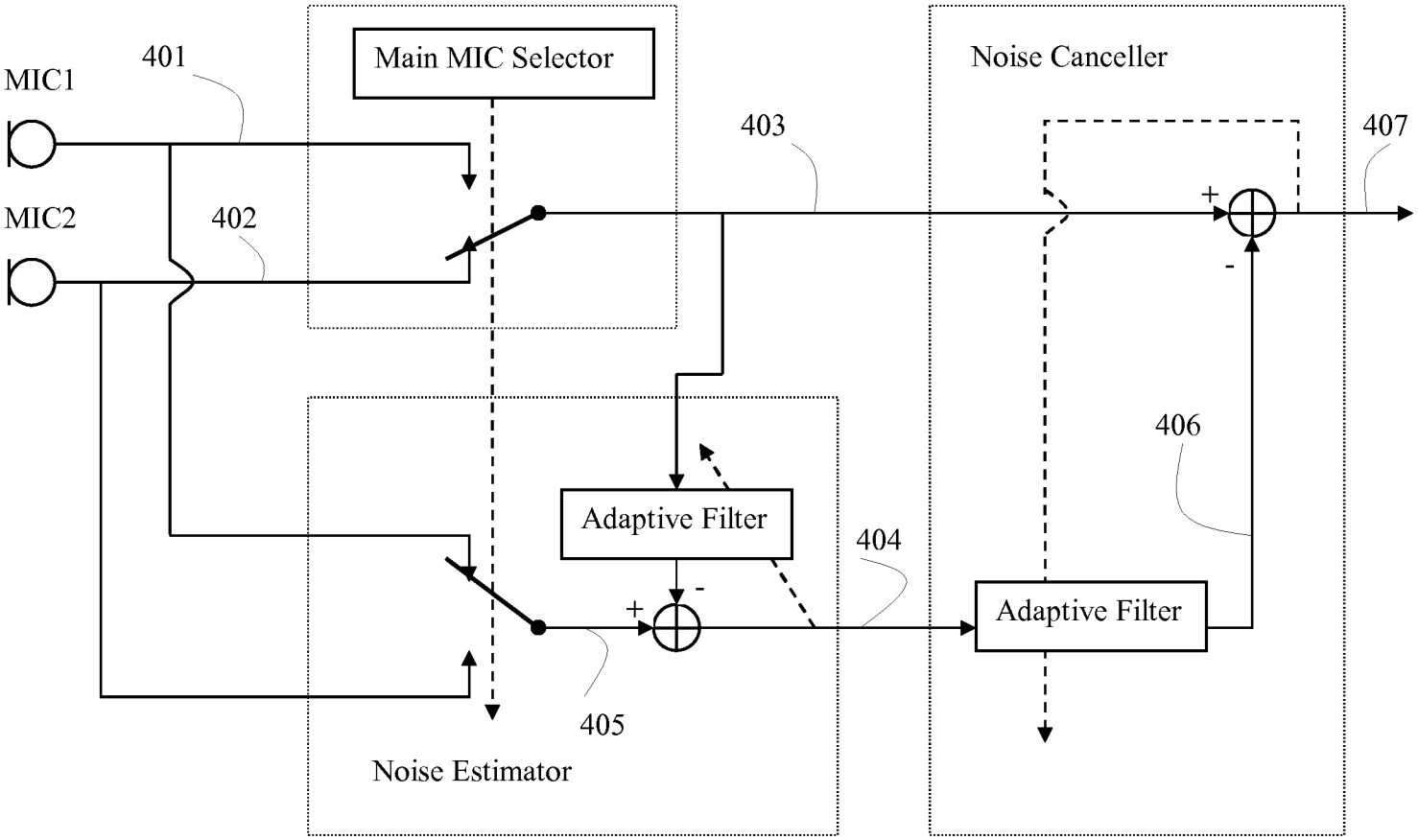
FIG. 4 illustrates a simplified beamformer/interference canceller for mono output system.
Figure 6:
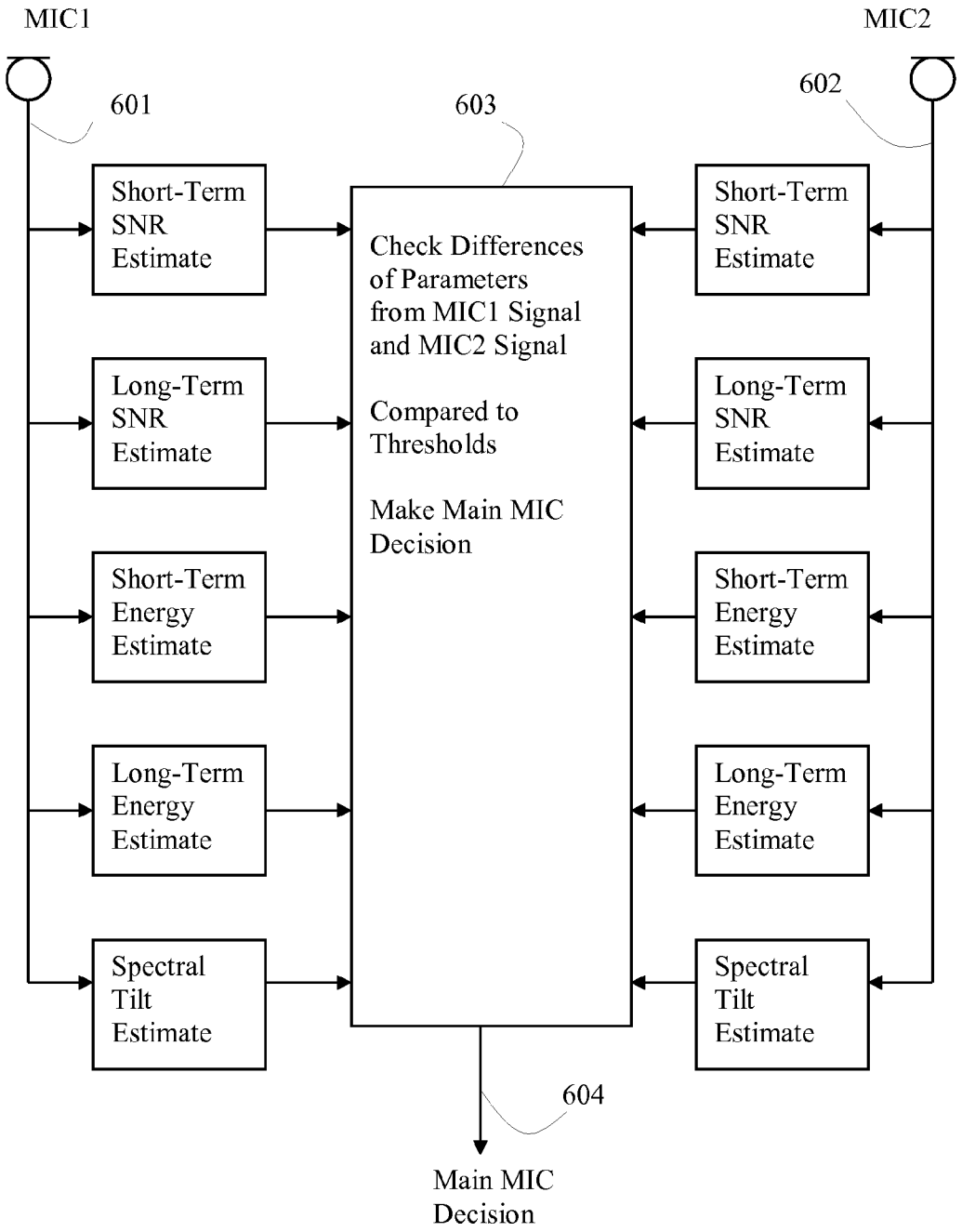
FIG. 6 illustrates a main MIC selector.

FIG. 4 proposed a simplified beamformer and noise canceller. Instead of using two fixed filters and four adaptive filters with FIG. 1 system, only two adaptive filters are used in FIG. 4 system. 401 and 402 are two input signals respectively from MIC1 (microphone 1) and MIC2 (microphone 2). The speech target signal 403 is selected as one of the two input signals from MIC1 and MIC2. The selected MIC is named as Main MIC. In mono output application, the Main MIC is adaptively selected from the two microphones, a detailed selection algorithm is illustrated in FIG. 6. In stereo output application, MIC1 is always selected as the Main MIC for one channel output and MIC2 is always selected as the Main MIC for another channel output. Unlike the speech target signal 103 in FIG. 1, which possibly has worse quality than the best one of the two input signals 101 and 102 from MIC1 and MIC2, the Main MIC Selector in FIG. 4 guarantees that the quality of the speech target signal 403 is not worse than the best one of the two input signals 401 and 402 from MIC1 and MIC2. For example, in mono output application, if the Main MIC Selector selects MIC2 as the main MIC, the Noise Estimator could take MIC1 or MIC2 signal as its input 405; in the case of taking MIC1 signal as its input 405, the MIC2 signal 403 passes through an adaptive filter to produce a replica signal 408 which tries to match the voice portion in the MIC1 signal 405; the replica signal 408 is used as a reference signal to cancel the voice portion in the MIC1 signal 405 in the Noise Estimator in order to obtain the noise/interference estimation signal 404. This noise/interference estimation signal 404 inputs to the Noise Canceller which works with an adaptive filter to produce a noise/interference replica 406 matching the noise/interference portion in the target signal 403. A noise/interference reduced speech signal 407 is obtained by subtracting the noise/interference replica signal 406 from the target signal 403. Comparing the traditional FIG. 1 system with the FIG. 4 system, not only the complexity of the FIG. 4 system is significantly reduced; but also the over-all performance of the FIG. 4 system becomes more robust.

Figure 5:
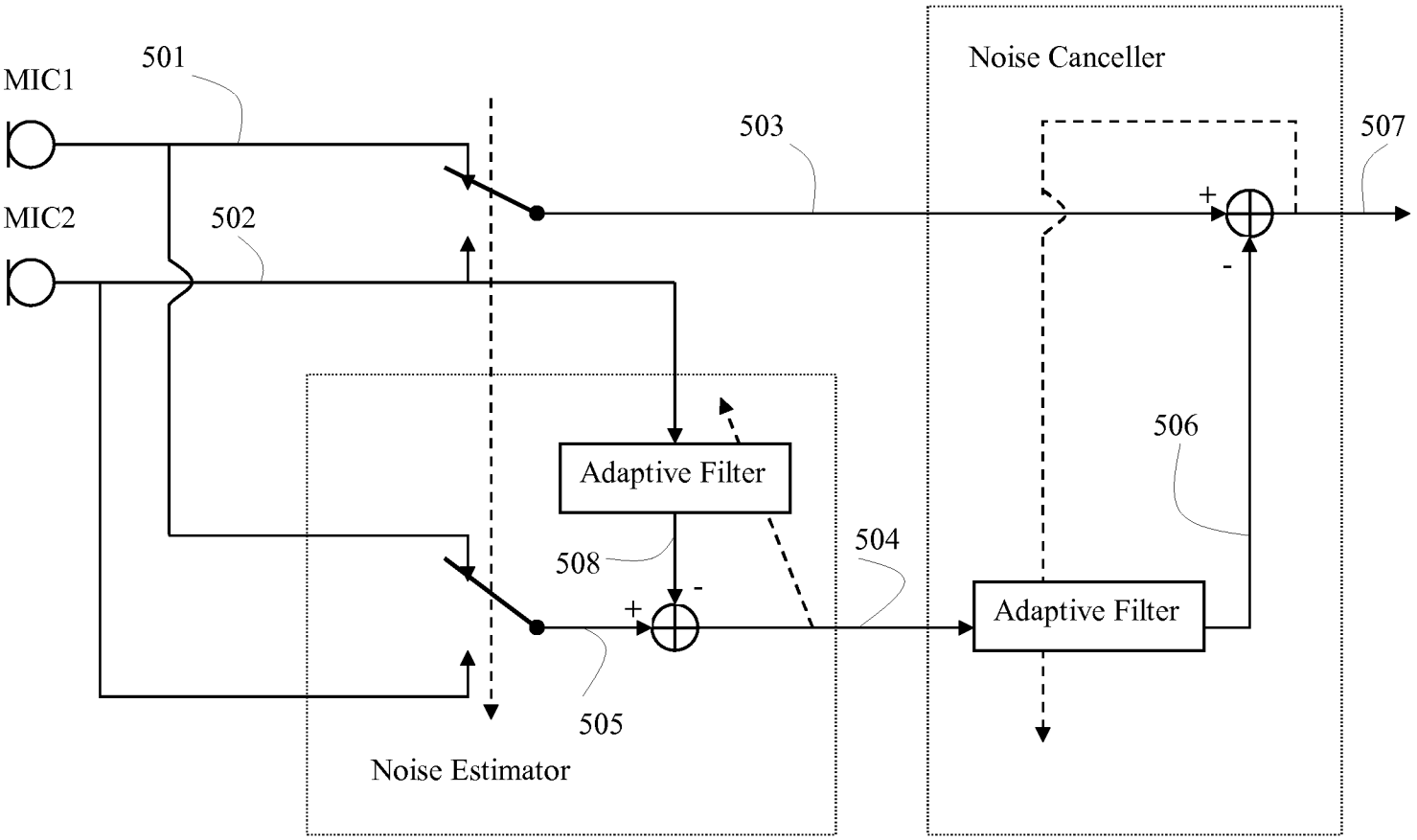
FIG. 5 illustrates a simplified beamformer/interference canceller for stereo output system.

FIG. 5 proposed a simplified beamformer and noise canceller for stereo output. In stereo application, one channel output should keep the difference from another channel output; in this case, we can not choose one channel output that has better quality than another channel; however, we can use another channel to reduce/cancel the noise/interference in the current channel; it is still based on the beamforming principle. FIG. 5 shows the noise/interference cancellation system for the channel signal from MIC1; the noise/interference cancellation system for the channel signal from MIC2 can be designed in a similar or symmetric way. As the system in FIG. 4, only two adaptive filters are used in FIG. 5 system instead of using two fixed filters and four adaptive filters with FIG. 1 system. 501 and 502 are two input signals respectively from MIC1 (microphone 1) and MIC2 (microphone 2). The speech target signal 503 is simply selected from MIC1. In stereo output application, MIC1 is always selected as the Main MIC for one channel output and MIC2 is always selected as the Main MIC for another channel output. For example, in stereo output application, if MIC1 is the main MIC, the Noise Estimator could take MIC1 signal as its input 505; the MIC2 signal 502 passes through an adaptive filter to produce a replica signal 508 which tries to match the voice portion in the MIC1 signal 505; the replica signal 508 is used as a reference signal to cancel the voice portion in the MIC1 signal 505 in the Noise Estimator in order to obtain the noise/interference estimation signal 504. This noise/interference estimation signal 504 inputs to the Noise Canceller which works with an adaptive filter to produce a noise/interference replica 506 matching the noise/interference portion in the target signal 503. A noise/interference reduced speech signal 507 is obtained by subtracting the noise/interference replica signal 506 from the target signal 503.

A robust Main MIC Selector is an important factor of success in the proposed FIG. 4 system. FIG. 6 proposed a robust Main MIC Selector. The following parameters are estimated respectively for MIC1 signal 501 and MIC2 signal 502: short-term SNR(Signal to Noise Ratio in energy domain, magnitude domain, or in dB domain), long-term SNR, short-term energy, long-term energy, and spectral tilt. The diagram block 503 calculates the differences of the corresponding parameters estimated respectively from MIC1 signal 501 and MIC2 signal 502; each parameter difference is compared to a threshold which could be a positive value or a negative value, depending on what is the main MIC of the past signal frame. By having a logic combination of all the parameters comparisons, a main MIC selection decision 504 can be made for the current signal frame.

For the clarity, some names commonly used in the technical domain are expressed as follows in a mathematical way. "energy" means an energy calculated on a frame of digital signal s(n), n is time index on the frame:

$$\text{Energy} = \sum_n [s(n)]^2 \tag{1}$$

"energy" can be expressed in dB domain:

$$\text{Energy_dB} = 10 \cdot \log\left(\sum_n [s(n)]^2\right) \tag{2}$$

"short-term energy" means a current energy; "long-term energy" means an energy obtained by smoothing and averaging a current energy with past energies; "spectral tilt" of a signal s(n) can be defined as:

$$\text{Tilt} = \frac{\sum_n s(n) \cdot s(n-1)}{\sum_n [s(n)]^2} \tag{3}$$

The following is a detailed example for the Main MIC Selector. Some parameters are first defined as:

- last_main_MIC_no: main MIC number for the last signal frame;
- current_main_MIC_no: main MIC number for the current signal frame;
- diff_SNR: difference SNR in dB=MIC1 input SNR in dB−MIC2 input SNR in dB;
- diff_SNR_sm: smoothed long-term difference SNR in dB=smoothed MIC1 input SNR in dB−smoothed MIC2 input SNR in dB;
- diff_energy: difference energy in dB=MIC1 input energy in dB−MIC2 input energy in dB;
- diff_energy_sm: smoothed long-term difference energy in dB=smoothed MIC1 input energy in dB−smoothed MIC2 input energy in dB;
- diff_tilt: difference spectral tilt=MIC1 input spectral tilt−MIC2 input spectral tilt;
- diff_tilt_sm: smoothed long-term difference spectral tilt=smoothed MIC1 input spectral tilt−smoothed MIC2 input spectral tilt;
- frame_count: frame number counter;
- speech_flag=1 means voice exists;
- speech_flag=0 means noise exists.

```
/* Detect main MIC */
if (last_main_MIC_no=2)
{
    Cond = ( (diff_energy _sm>7 AND diff_ energy >7 ) OR
             (diff_SNR_sm>3 AND diff_SNR>3 ) OR
             (speech_flag=1 AND diff_ energy_sm>3) OR
             (speech_flag=1 AND diff_SNR_sm>2) ) AND
             (diff_tilt_sm>−0.2f AND diff_tilt>−0.2f) OR
             (speech_flag=1 AND diff_erg_sm>5) OR
             (speech_flag=1 AND diff_SNR_sm>4);
  if (frame_count<8 )
  {
      if (frame_count>2 AND (Cond is true OR diff_energy_sm>0.5 OR
              diff_energy>16) )
          current_main_MIC_no = 1;
  }
  else if (frame_count <32)
  {
      if ( Cond is true OR diff_energy_sm>1.5 OR diff_energy>16 )
```

-continued

```
                current_main_MIC_no = 1;
        }
        else if (frame_count<200)
        {
            if (Cond is true OR diff_erg_sm>5 )
              current_main_MIC_no = 1;
        }
        else if ( Cond )
        {
              current_main_MIC_no = 1;
        }
}
if (last_main_MIC_no=1)
{
        Cond = ( (diff_energy_sm<-7 AND diff_energy <-7 ) OR
                 (diff_SNR_sm<-3 AND diff_SNR<-3 ) OR
                 (speech_flag=1 AND diff_energy_sm<-3) OR
                 (speech_flag=1 AND diff_SNR_sm<-2) ) AND
                 (diff_tilt_sm<0.2f AND diff_tilt<0.2f) OR
                 (speech_flag=1 AND diff_erg_sm<-5) OR
                 (speech_flag=1 AND diff_SNR_sm<-4);
         if (frame_count<8 )
         {
             if (frame_count>2 AND (Cond is true OR diff_energy_sm<-0.5 OR
                     diff_energy<-16) )
                 current_main_MIC_no = 1;
         }
         else if (frame_count <32)
         {
             if ( Cond is true OR diff_energy_sm<-1.5 OR diff_energy <-16 )
                 current_main_MIC_no = 1;
        }
        else if (frame _count<200)
        {
             if (Cond is true OR diff_erg_sm<-5 )
                 current_main_MIC_no = 1;
        }
        else if ( Cond )
        {
                 current_main_MIC_no = 1;
        }
    }
```

Figure 7:
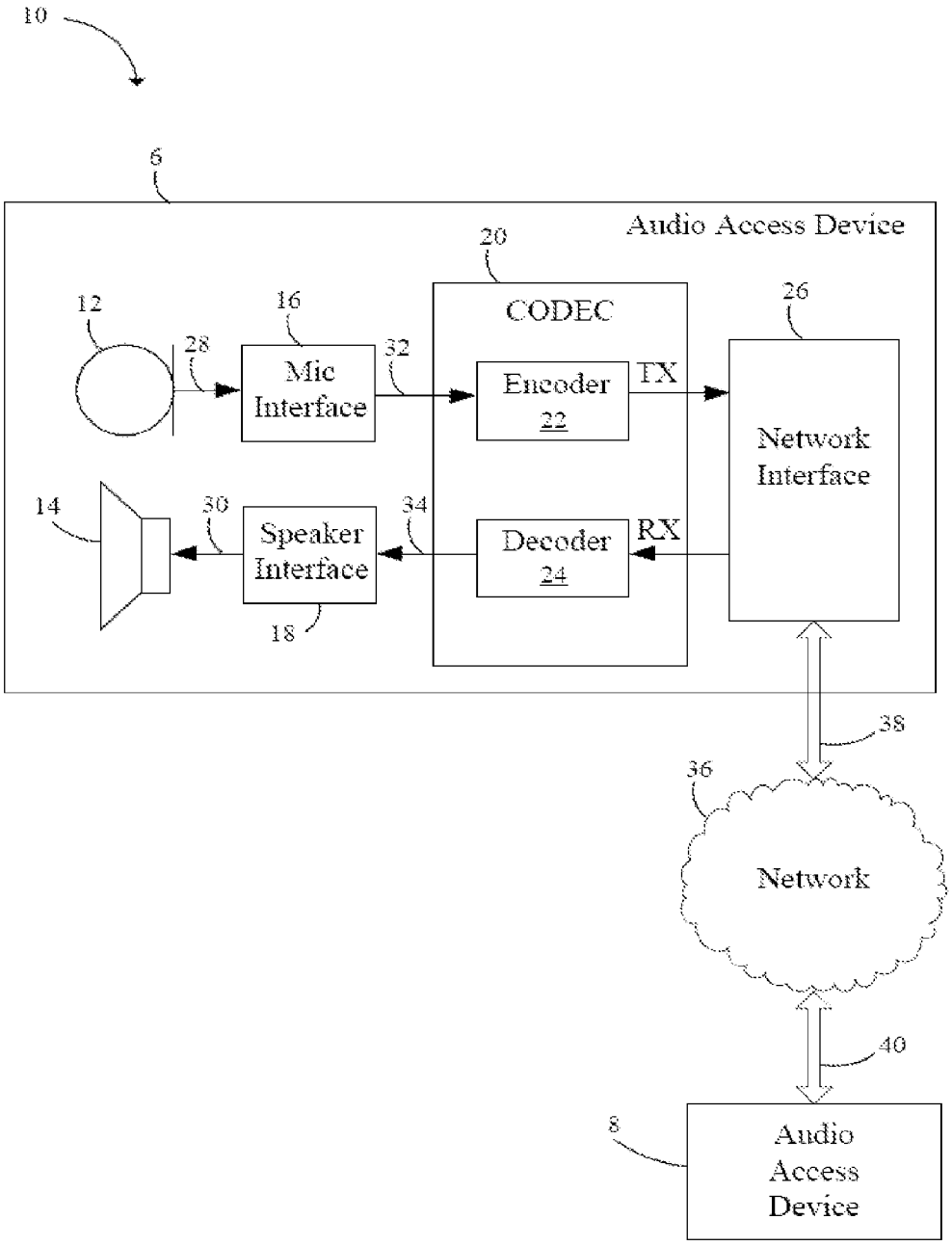
FIG. 7 illustrates a communication system according to an embodiment of the present invention.

FIG. 7 illustrates a communication system 10 according to an embodiment of the present invention.

Communication system 10 has audio access devices 7 and 8 coupled to a network 36 via communication links 38 and 40. In one embodiment, audio access device 7 and 8 are voice over internet protocol (VOIP) devices and network 36 is a wide area network (WAN), public switched telephone network (PTSN) and/or the internet. In another embodiment, communication links 38 and 40 are wireline and/or wireless broadband connections. In an alternative embodiment, audio access devices 7 and 8 are cellular or mobile telephones, links 38 and 40 are wireless mobile telephone channels and network 36 represents a mobile telephone network.

The audio access device 7 uses a microphone 12 to convert sound, such as music or a person's voice into an analog audio input signal 28. A microphone interface 16 converts the analog audio input signal 28 into a digital audio signal 33 for input into an encoder 22 of a CODEC 20. The encoder 22 can include a speech enhancement block which reduces noise/interferences in the input signal from the microphone(s). The encoder 22 produces encoded audio signal TX for transmission to a network 26 via a network interface 26 according to embodiments of the present invention. A decoder 24 within the CODEC 20 receives encoded audio signal RX from the network 36 via network interface 26, and converts encoded audio signal RX into a digital audio signal 34. The speaker interface 18 converts the digital audio signal 34 into the audio signal 30 suitable for driving the loudspeaker 14.

In embodiments of the present invention, where audio access device 7 is a VOIP device, some or all of the components within audio access device 7 are implemented within a handset. In some embodiments, however, microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 7 can be implemented and partitioned in other ways known in the art.

In embodiments of the present invention where audio access device 7 is a cellular or mobile telephone, the elements within audio access device 7 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The speech processing for reducing noise/interference described in various embodiments of the present invention may be implemented in the encoder 22 or the decoder 24, for example. The speech processing for reducing noise/interference may be implemented in hardware or software in various embodiments. For example, the encoder 22 or the decoder 24 may be part of a digital signal processing (DSP) chip.

Figure 8:
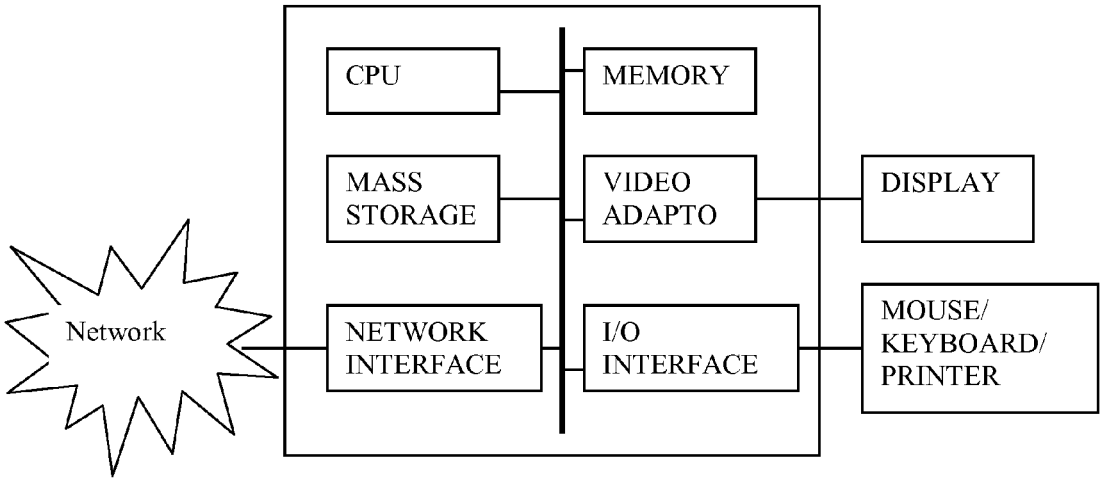
FIG. 8 illustrates a block diagram of a processing system that may be used for implementing the devices and methods disclosed herein.

FIG. 8 illustrates a block diagram of a processing system that may be used for implementing the devices and methods disclosed herein. Specific devices may utilize all of the components shown, or only a subset of the components, and levels of integration may vary from device to device. Furthermore, a device may contain multiple instances of a component, such as multiple processing units, processors, memories, transmitters, receivers, etc. The processing system may comprise a processing unit equipped with one or more input/output devices, such as a speaker, microphone, mouse, touchscreen, keypad, keyboard, printer, display, and the like. The processing unit may include a central processing unit (CPU), memory, a mass storage device, a video adapter, and an I/O interface connected to a bus.

The bus may be one or more of any type of several bus architectures including a memory bus or memory controller, a peripheral bus, video bus, or the like. The CPU may comprise any type of electronic data processor. The memory may comprise any type of system memory such as static random access memory (SRAM), dynamic random access memory (DRAM), synchronous DRAM (SDRAM), read-only memory (ROM), a combination thereof, or the like. In an embodiment, the memory may include ROM for use at boot-up, and DRAM for program and data storage for use while executing programs.

The mass storage device may comprise any type of storage device configured to store data, programs, and other information and to make the data, programs, and other information accessible via the bus. The mass storage device may comprise, for example, one or more of a solid state drive, hard disk drive, a magnetic disk drive, an optical disk drive, or the like.

The video adapter and the I/O interface provide interfaces to couple external input and output devices to the processing unit. As illustrated, examples of input and output devices include the display coupled to the video adapter and the mouse/keyboard/printer coupled to the I/O interface. Other devices may be coupled to the processing unit, and additional or fewer interface cards may be utilized. For example, a serial interface such as Universal Serial Bus (USB) (not shown) may be used to provide an interface for a printer.

The processing unit also includes one or more network interfaces, which may comprise wired links, such as an Ethernet cable or the like, and/or wireless links to access nodes or different networks. The network interface allows the processing unit to communicate with remote units via the networks. For example, the network interface may provide wireless communication via one or more transmitters/transmit antennas and one or more receivers/receive antennas. In an embodiment, the processing unit is coupled to a local-area network or a wide-area network for data processing and communications with remote devices, such as other processing units, the Internet, remote storage facilities, or the like.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. For example, various embodiments described above may be combined with each other.

Although the present invention and its advantages have been described in detail, it should be understood that various changes, substitutions and alterations can be made herein without departing from the spirit and scope of the invention as defined by the appended claims. For example, many of the features and functions discussed above can be implemented in software, hardware, or firmware, or a combination thereof. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for cancelling noise/interference component signal in speech signal enhancement processing, the method comprising:

selecting one of microphones as a main microphone wherein only the signal from the main microphone is used as a target signal, and the selection of the main microphone is adaptive for mono output, based on parameters calculated using the input signals from the microphones;

estimating the noise/interference component signal by subtracting voice component signal from a first microphone input signal wherein the voice component signal is evaluated by passing a second microphone input signal through a first adaptive filter;

outputting a noise/interference reduced signal by subtracting a noise replica signal from the target signal, wherein the noise replica signal is produced by passing the estimated noise/interference component signal through a second adaptive filter.

2. The method of claim 1, wherein cancelling the noise/interference component signal is based on a beamforming principle.

3. The method of claim 1, wherein the selection of the main microphone is based on SNR parameter.

4. The method of claim 1, wherein the selection of the main microphone is based on energy parameter.

5. The method of claim 1, wherein the selection of the main microphone is based on spectral tilt parameter.

6. The method of claim 1, wherein the selection of the main microphone is based on SNR parameter, energy parameter and/or spectral tilt parameter.

7. A speech processing apparatus for cancelling noise/interference component signal in speech signal enhancement processing, the apparatus comprising:

a processor; and a non-transitory computer readable medium storing programming for execution by the processor, the programming including instructions to:

select one of microphones as a main microphone wherein only the signal from the main microphone is used as a target signal, and the selection of the main microphone is adaptive for mono output, based on parameters calculated using the input signals from the microphones;

estimate the noise/interference component signal by subtracting voice component signal from a first microphone input signal wherein the voice component signal is evaluated by passing a second microphone input signal through a first adaptive filter;

output a noise/interference reduced signal by subtracting a noise replica signal from the target signal, wherein the noise replica signal is produced by passing the estimated noise/interference component signal through a second adaptive filter.

8. The method of claim 7, wherein cancelling the noise/interference component signal is based on a beamforming principle.

9. The method of claim 7, wherein the selection of the main microphone is based on SNR parameter.

10. The method of claim 7, wherein the selection of the main microphone is based on energy parameter.

11. The method of claim 7, wherein the selection of the main microphone is based on spectral tilt parameter.

12. The method of claim 7, wherein the selection of the main microphone is based on SNR parameter, energy parameter and/or spectral tilt parameter.

* * * * *